US008494418B2

(12) United States Patent
Mabuchi et al.

(10) Patent No.: US 8,494,418 B2
(45) Date of Patent: Jul. 23, 2013

(54) DEVELOPMENT DEVICE AND IMAGE FORMING APPARATUS HAVING THE SAME

(75) Inventors: Sayo Mabuchi, Osaka (JP); Minoru Wada, Osaka (JP); Seishi Ojima, Osaka (JP)

(73) Assignee: Kyocera Mita Corporation (JP)

( * ) Notice: Subject to any disclaimer, the term of this patent is extended or adjusted under 35 U.S.C. 154(b) by 272 days.

(21) Appl. No.: 12/971,660

(22) Filed: Dec. 17, 2010

(65) Prior Publication Data

US 2011/0150539 A1 Jun. 23, 2011

(30) Foreign Application Priority Data

Dec. 21, 2009 (JP) ..... 2009-289332
Dec. 21, 2009 (JP) ..... 2009-289476
Apr. 14, 2010 (JP) ..... 2010-093073

(51) Int. Cl.
*G03G 15/09* (2006.01)

(52) U.S. Cl.
USPC ..... 399/275

(58) Field of Classification Search
USPC ..... 399/274, 275, 277, 284
See application file for complete search history.

(56) References Cited

U.S. PATENT DOCUMENTS 4,386,577 A 6/1983 Hosono et al.
4,387,664 A 6/1983 Hosono et al.
4,421,057 A 12/1983 Hosono et al.
4,458,627 A 7/1984 Hosono et al.
4,887,131 A * 12/1989 Kinoshita et al. ..... 399/275
RE34,724 E 9/1994 Hosono et al.
6,021,295 A * 2/2000 Ochiai et al. ..... 399/275
2008/0181676 A1* 7/2008 Yamagishi et al. ..... 399/275
2011/0064484 A1* 3/2011 Wada et al. ..... 399/274
2011/0064485 A1* 3/2011 Ojima et al. ..... 399/274

FOREIGN PATENT DOCUMENTS

JP 59-8831 2/1984
JP 2003-255710 9/2003
JP 2005-148413 6/2005
JP 2005-189753 7/2005

* cited by examiner

*Primary Examiner* — Walter L Lindsay, Jr.
*Assistant Examiner* — Rodney Bonnette
(74) *Attorney, Agent, or Firm* — Gerald E. Hespos; Michael J. Porco; Matthew T. Hespos

(57) ABSTRACT

The development device includes a developer storage part storing a developer, a developer carrier having a carrying surface for carrying the developer and a first magnet, and receiving the developer from the developer storage part on the carrying surface while rotating in a predetermined direction, and supplying the developer to a predetermined image carrier, a magnetic member formed from a magnetic material, forming a predetermined regulatory gap with the carrying surface, and arranged opposite to the first magnet, a second magnet disposed more upstream than the magnetic member when viewed from the rotating direction of the developer carrier, and having a magnetic pole of the same polarity as the first magnet, and a deterioration suppressing part suppressing deterioration of the developer transported to the regulatory gap along with the rotation of the developer carrier.

18 Claims, 15 Drawing Sheets

FIG. 6

| | MAGNETIC FORCE OF REGULATING POLE | MAGNETIC FORCE OF MAGNET | REGULATORY GAP | BRUSH HEIGHT | THIN LAYER STABILITY | IMAGE DENSITY DEGRADATION | STREAK NOISE |
|---|---|---|---|---|---|---|---|
| EXAMPLE 1 | 30mT | 35mT | 0.6mm | 0.38mm | ○ | ○ | ○ |
| EXAMPLE 2 | 30mT | 55mT | 0.9mm | 0.52mm | ○ | ○ | ○ |
| EXAMPLE 3 | 30mT | 75mT | 1.2mm | 0.73mm | ○ | ○ | △ |
| EXAMPLE 4 | 50mT | 55mT | 0.7mm | 0.45mm | ○ | ○ | ○ |
| EXAMPLE 5 | 50mT | 75mT | 0.9mm | 0.35mm | ○ | ○ | ○ |
| EXAMPLE 6 | 70mT | 75mT | 1.1mm | 0.61mm | ○ | ○ | △ |
| EXAMPLE 7 | 30mT | 55mT | 0.6mm | 0.48mm | ○ | ○ | ○ |
| EXAMPLE 8 | 30mT | 55mT | 1.2mm | 0.53mm | ○ | ○ | ○ |
| EXAMPLE 9 | 30mT | 55mT | 0.6mm | 0.49mm | ○ | ○ | ○ |
| EXAMPLE 10 | 30mT | 55mT | 1.2mm | 0.48mm | ○ | ○ | ○ |
| COMPARATIVE EXAMPLE 1 | 30mT | NO MAGNET | 0.3mm | 0.6mm | × | × | △ |
| COMPARATIVE EXAMPLE 2 | 50mT | 35mT | 0.3mm | 0.5mm | ○ | × | ○ |
| COMPARATIVE EXAMPLE 3 | 70mT | 55mT | 0.4mm | 0.42mm | ○ | × | ○ |

FIG. 7

| | CARRIER | | MAGNETIC FORCE OF REGULATING PART | | EVALUATION RESULT | | |
|---|---|---|---|---|---|---|---|
| | CARRIER TYPE | SATURATION MAGNETIZATION (emu/g) | MAGNETIC FORCE OF REGULATING POLE | MAGNETIC FORCE OF MAGNET | THIN LAYER STABILITY | IMAGE DENSITY DEGRADATION | STREAK NOISE |
| EXAMPLE 11 | CARRIER A | 62 | 30mT | 55mT | ○ | ○ | ○ |
| EXAMPLE 12 | CARRIER A | 62 | 30mT | 75mT | ○ | ○ | △ |
| EXAMPLE 13 | CARRIER B | 75 | 30mT | 55mT | ○ | ○ | ○ |
| EXAMPLE 14 | CARRIER C | 40 | 30mT | 75mT | ○ | ○ | ○ |
| COMPARATIVE EXAMPLE 4 | CARRIER D | 80 | 30mT | 55mT | ○ | × | ○ |
| COMPARATIVE EXAMPLE 5 | CARRIER E | 35 | 30mT | 75mT | × | ○ | ○ |

FIG. 12

| | | |
|---|---|---|
| COMPARATIVE EXAMPLE 1 | ONLY REGULATING BLADE | |
| COMPARATIVE EXAMPLE 2 | TRANSPORT AMOUNT REGULATING SURFACE | REGULATING ANGLE 0° |
| COMPARATIVE EXAMPLE 3 | MAGNET | THICKNESS 2mm MAGNET 35 mT STEP 0mm |
| COMPARATIVE EXAMPLE 4 | | THICKNESS 2mm MAGNET 35 mT STEP 1mm |
| COMPARATIVE EXAMPLE 5 | | THICKNESS 2mm MAGNET 55 mT STEP 0mm |
| COMPARATIVE EXAMPLE 6 | | THICKNESS 2mm MAGNET 55 mT STEP 2mm |
| EXAMPLE 1 | MAGNET + TRANSPORT AMOUNT REGULATING SURFACE | THICKNESS 1mm MAGNET 35mT STEP 0mm REGULATING ANGLE 30° |
| EXAMPLE 2 | | THICKNESS 1mm MAGNET 35mT STEP 0mm REGULATING ANGLE 10° |
| EXAMPLE 3 | | THICKNESS 1mm MAGNET 55mT STEP 0mm REGULATING ANGLE 30° |
| EXAMPLE 4 | | THICKNESS 0.5mm MAGNET 35mT STEP 0mm REGULATING ANGLE 30° |

DEVELOPMENT DEVICE AND IMAGE FORMING APPARATUS HAVING THE SAME

BACKGROUND OF THE INVENTION

1. Field of the Invention

The present invention relates to a development device for forming a toner image on a predetermined image carrier, and an image forming apparatus having the same.

2. Description of the Related Art

An image forming apparatus such as a copying machine, printer, facsimile, a multi-function machine thereof and the like which employs the electrophotographic system includes a development device for supplying a toner to an image carrier (for example, a photoreceptor drum or a transfer belt) and forming a toner image on the image carrier.

The development device includes, as its basic constituent elements, a developer storage part for storing the developer, a development roller for receiving the developer from the developer storage part and forming a toner image on the image carrier by supplying the developer to the image carrier, and a regulating blade which is placed opposite to the development roller so as to form a regulatory gap with the development roller and which regulates the layer thickness of the developer on the development roller.

With this kind of development device, in order to form a favorable toner image on the image carrier, it is necessary to cause the developer layer to be thinned and uniform prior to the development roller supplying the developer to the image carrier.

With the development device of a first relevant technology, a magnet member is disposed on the upstream surface of the regulating blade when viewed from the rotating direction of the development roller. A magnetic field is generated between the regulating blade made from a magnetic material and a regulating pole disposed on the development roller, and the magnet member causes the magnetic flux density of the magnetic field to increase, and the magnetic line of the magnetic field is concentrated at the upstream portion in the regulating blade. The developer layer (magnetic brush layer) is thereby regulated and thinned and becomes uniform.

Moreover, with the development device of a second relevant technology, the development roller has a built-in magnet roll for pumping the developer onto its outer peripheral surface, and the regulating blade is formed from a magnetic material. Since the magnetic field of the magnetic pole opposite to the regulating blade in the magnet roll is concentrated on the regulating blade, the regulating blade is able to regulate the developer layer (so-called magnetic brush layer) on the outer peripheral surface to become uniform in the regulatory gap, which is a range that is affected by the magnetic field.

Nevertheless, with the development device of the first relevant technology, the regulating force of the regulating pole, the regulating blade and the magnet member for regulating the developer in the regulatory gap; that is, the restraint of the regulating pole, the regulating blade and the magnet member for restraining the developer in the regulatory gap is too strong. Thus, the stress applied to the developer upon regulating the magnetic brush layer increases, and the developer tends to deteriorate. If the developer deteriorates, it becomes difficult to form a favorable toner image on the image carrier, and consequently becomes difficult to form a favorable image on a sheet.

Moreover, with the development device of the second relevant technology, since the amount of developer that is transported to the regulating blade is considerably more than the amount of developer that passes through the regulatory gap, the developer tends to accumulate in a range around the regulating blade that is not affected by the magnetic field. The accumulated developers mutually collide or collide with the wall part defining the developer storage part, and will thereby deteriorate. In addition, an accumulated developer tends to fall into a compressed state, or a so-called packed state, and will thereby deteriorate. If the developer deteriorates as described above, it becomes difficult to form a favorable toner image on the image carrier.

SUMMARY OF THE INVENTION

Thus, in light of the foregoing circumstances, an object of this invention is to provide a development device capable of inhibiting the deterioration of the developer while realizing the thinning and uniformity of the developer layer, and an image forming apparatus comprising the same.

In order to achieve the foregoing object, the development device according to one aspect of the present invention includes a developer storage part storing a developer while agitating the developer, a developer carrier having a carrying surface for carrying the developer, and a first magnet, the developer carrier receiving the developer on the carrying surface from the developer storage part while rotating in a predetermined direction, and supplying the developer to a predetermined image carrier, a magnetic member formed from a magnetic material, the magnetic member forming a predetermined regulatory gap with the carrying surface and arranged opposite to the first magnet, a second magnet arranged more upstream than the magnetic member when viewed from the rotating direction of the developer carrier, and having a magnetic pole of the same polarity as the first magnet, and a deterioration suppressing part suppressing deterioration of the developer that is transported to the regulatory gap along with the rotation of the developer carrier.

Other objects and specific advantages of the present invention shall become more apparent from the appended drawings and the ensuing explanation.

BRIEF DESCRIPTION OF THE DRAWINGS

FIG. 6 is a diagram showing the results of experiments that were conducted with respect to the thinning stability of the magnetic brush layer, degradation of the image density upon printing, and generation of streaky noise.

FIG. 7 is a diagram showing the results of experiments that were conducted based on different saturization magnetization of the carrier with respect to the thinning stability of the magnetic brush layer, degradation of the image density upon printing, and generation of streaky noise.

FIG. 12 is a diagram showing the setting conditions of the Examples and Comparative Examples that were used in the experiments on how the transport amount of the developer layer that passed through a regulatory gap changes upon changing the size of such regulatory gap.

DETAILED DESCRIPTION OF THE PREFERRED EMBODIMENTS

A development device and an image forming apparatus equipped with such development device according to an embodiment of the present invention are now explained with reference to the attached drawings.

Figure 1:
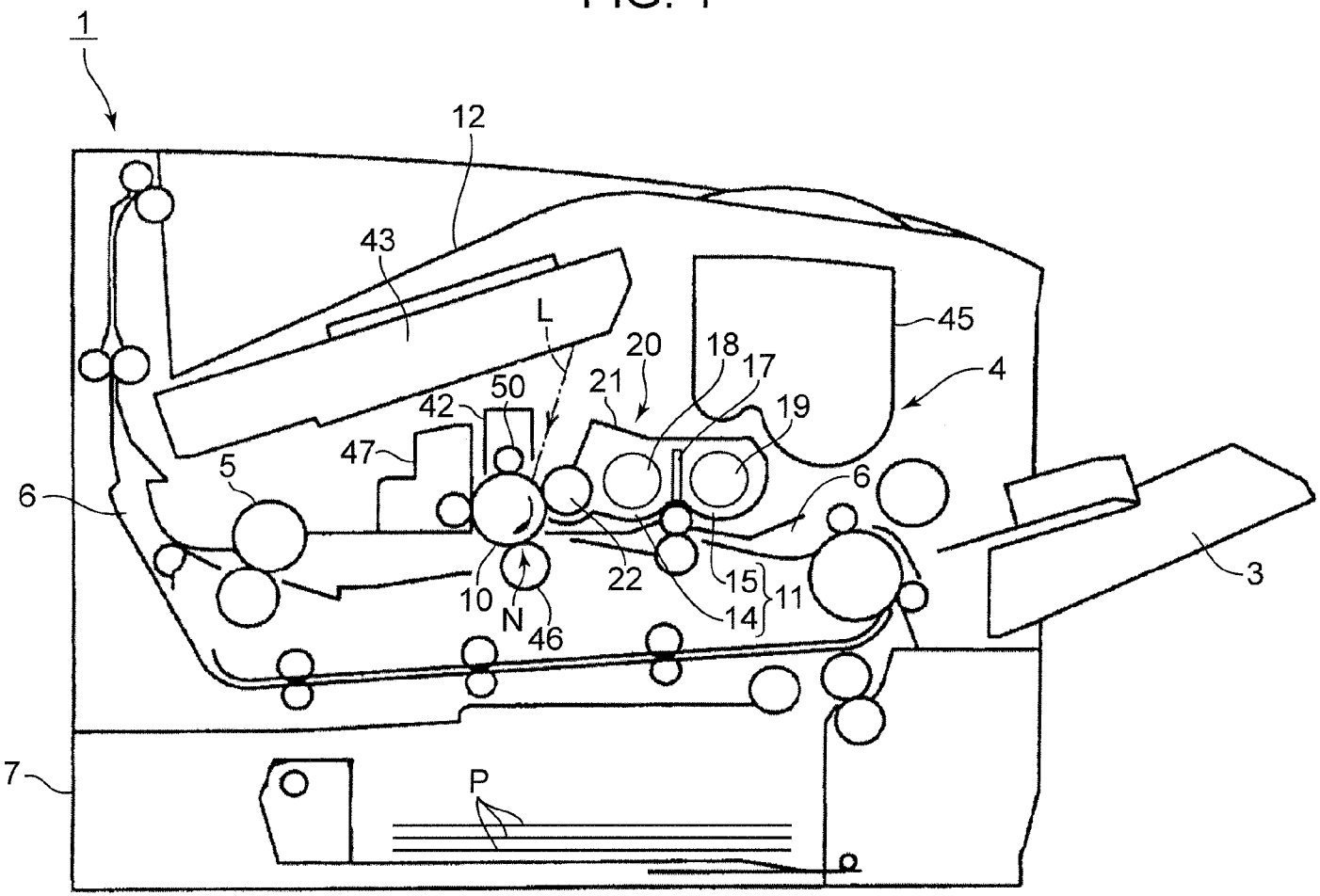
FIG. 1 is a diagram schematically showing the internal structure of the image forming apparatus equipped with the development device according to the first embodiment of the present invention.

The development device 20 and the image forming apparatus 1 equipped with the development device 20 according to the first embodiment are foremost explained. FIG. 1 is a diagram schematically showing the internal structure of the image forming apparatus 1 equipped with the development device 20 of the first embodiment. The image forming apparatus 1 shown in FIG. 1 is a black-and-white printer, but is not limited thereto, and may also be a copying machine, a facsimile device, or a multi-function machine comprising the functions thereof.

The image forming apparatus 1 includes an image forming part 4 for forming a toner image on paper P (sheet) based on image data from the outside (for example, a personal computer), a fixation part 5 for heating the toner image formed on the paper P and fixating it on the paper P, a paper feed cassette 7 that houses the paper P, a paper discharge tray 12 to which the paper P is discharged, a transport path 6 for transporting the paper P from the paper feed cassette 7 to the paper discharge tray 12 via the image forming part 4 and the fixation part 5, a manual feed tray 3 provided to the right-side surface in FIG. 1 of the image forming apparatus 1, and an operating unit (not shown) provided with a plurality of menu setting keys and the like for setting various menus.

The image forming part 4 includes a photoreceptor drum 10 (image carrier), a charging unit 42 for performing charge processing to the photoreceptor drum 10, an exposure unit 43 for irradiating a laser beam L to the charged photoreceptor drum 10 and forming an electrostatic latent image, a development device 20 for causing the toner to electrostatically adhere to the electrostatic latent image formed on the photoreceptor drum 10 and visualizing the toner image, a toner cartridge 45 for supplying the internally filled toner to the development device 20, a transfer roller 46 (transfer member) for transferring the developed toner image onto the paper P, and a toner removing unit 47 for removing and recovering the toner remaining on the drum surface of the photoreceptor drum 10. Note that, when viewed from the rotating direction (clockwise direction in FIG. 1) of the photoreceptor drum 10, the charging unit 42, the development device 20, the transfer roller 46, and the toner removing unit 47 are disposed along the circumferential direction of the photoreceptor drum 10. Moreover, the exposure unit 43 is disposed above the charging unit 42.

The photoreceptor drum 10 is a drum with a photoreceptor in which an amorphous silicon layer as a positively-charged photoconductor is vapor-deposited, for example, on the surface of an aluminum cylinder. The layer thickness of the amorphous silicon layer and the linear velocity of the photoreceptor drum 10 are suitably set.

The charging unit 42 includes, for example, a charging roller 50. The charging roller 50 is configured from a cored bar, and an epichlorohydrin rubber layer covering the cored bar. Moreover, the charging roller 50 is of a contact-charging system in which the circumferential surface thereof is subject to approximately point contact with the drum surface of the photoreceptor drum 10, and uniformly charges the surface potential of the drum surface by applying a predetermined reference charge voltage (reference charge bias) superimposed with DC voltage and AC voltage on the drum surface.

The exposure unit 43 has a polygon mirror (not shown) for guiding a laser beam L based on the image data input from an external PC (personal computer) or the like to the drum surface of the photoreceptor drum 10. The polygon mirror forms an electrostatic latent image on the drum surface by scanning the drum surface of the photoreceptor drum 10 with laser beam L while being rotated with a predetermined drive source. The development device 20 supplies the toner to the electrostatic latent image and thereby forms a toner image on the drum surface.

The transfer roller 46 is pressure-welded to the drum surface of the photoreceptor drum 10 in the transport path 6, and a nip part N is formed between the transfer roller 46 and the drum surface. Since a voltage of reverse polarity as the surface potential of the drum surface is applied to the transfer roller 46, the toner image on the drum surface is transferred onto the paper P upon the paper P passing through the nip part N. The paper P that passed through the nip part N passes through the transport path 6 and is transported to the fixation part 5.

At the fixation part 5, the toner image on the paper P is heated and fixated onto the paper P, and the paper P thereafter passes through the transport path 6 and is transported to the paper discharge tray 12.

Figure 2:
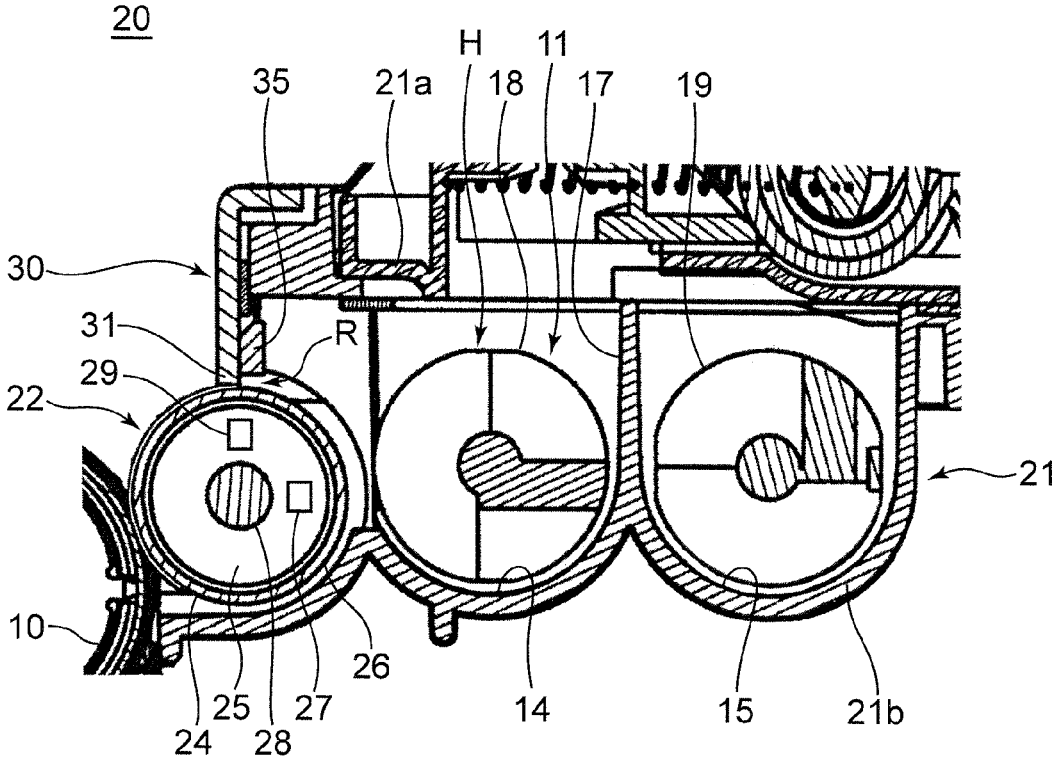
FIG. 2 is an enlarged view of the development device of the first embodiment.

The development device 20 is now explained in detail with reference to FIG. 2 in addition to FIG. 1. FIG. 2 is an enlarged view of the development device 20. The development device 20 uses a two-component developer made of a mixture of a nonmagnetic body toner and a magnetic carrier, and, as shown in FIG. 1 and FIG. 2, includes a development vessel 21 which defines the internal space of the development device 20, a developer storage part 11 for storing the developer, and a development roller 22 (developer carrier) opposite to the drum surface of the photoreceptor drum 10 as its basic constituent elements.

The development vessel 21 includes a bottom frame 21*b*, and a main body frame 21*a* which covers the bottom frame 21*b* from above, and the internal space is defined between both frames 21*a*, 21*b*.

The developer storage part 11 includes a developer storage space H which occupies a majority of the internal space for storing the developer, and two adjacent developer cyclic paths 14, 15 formed on the bottom frame 21*b* in the developer storage space H and extending in the longitudinal direction (perpendicular direction relative to the plane of paper of FIG. 1) of the development device 20.

The developer cyclic paths 14, 15 are mutually partitioned in the longitudinal direction with a partition plate 17 made of, for example, metal such as aluminum, but both ends thereof in the longitudinal direction are in mutual communication. Moreover, a screw feeder 18, 19 for agitating and transporting the developer, based on rotation, is rotatably mounted on each developer cyclic path 14, 15.

With the screw feeders 18, 19, since the transport directions are set in mutually reverse directions, the developer is agitated and transported between the developer cyclic path 14 and the developer cyclic path 15. Based on this agitation, the nonmagnetic body toner and the magnetic carrier are mixed, and the toner is charged with the carrier. The charged developer is supplied from the developer cyclic path 14 to the development roller 22. The developer storage part 11 receives the toner in the developer storage space H from the toner cartridge 45 via a resupply port not shown.

The development roller 22 is formed, for example, a nonmagnetic material such as aluminum, and is a roller member including a cylindrical development sleeve 24 extending in the longitudinal direction of the development device 20 (that is, axis direction of the photoreceptor drum 10), and a rotational axis not shown for rotating the development sleeve 24 in the counterclockwise direction in FIG. 2.

The development sleeve 24 is placed opposite to the photoreceptor drum 10 in a state where a gap of 0.2 mm to 0.4 mm is formed between its outer peripheral surface 26 (carrying surface) and the drum surface of the photoreceptor drum 10. The development sleeve 24 includes a so-called magnet roll 25 extending in the longitudinal direction of the development sleeve 24 in a state where it is fixedly supported with a support shaft 28.

The magnet roll 25 is formed with a pumping pole 27 for magnetically pumping the developer from the developer storage part 11 onto the outer peripheral surface 26 of the development sleeve 24. The pumping pole 27 is placed opposite to the developer cyclic path 14 via the outer peripheral surface 26 of the development sleeve 24, and magnetically attaches (carries) the developer in the developer cyclic path 14 to the outer peripheral surface 26 of the rotating development sleeve 24. The developer that is pumped onto the outer peripheral surface 26 with the pumping pole 27 is transported toward a regulating part R pursuant to the rotation of the development sleeve 24 as a magnetic brush layer D1 (FIG. 3) made of a so-called magnetic brush DB.

The regulating part R is provided for achieving the thinning and uniformity of the layer thickness of the magnetic brush layer D1 on the outer peripheral surface 26. In this embodiment, the regulating part R is configured from a regulating pole 29 (first magnet), a magnetic member 30 and a magnet member 35 (second magnet). The regulating part R is now explained with reference to FIG. 3.

The magnetic member 30 is disposed in a state of facing the development sleeve 24 above the development sleeve 24, and is a laminar member extending in the longitudinal direction of the development sleeve 24. The magnetic member 30 has a tip part 31 extending toward the outer peripheral surface 26 of the development sleeve 24, and a regulatory gap G of a predetermined size is formed between the end surface 32 of the tip part 31 and the outer peripheral surface 26 of the development sleeve 24. The size of the regulatory gap G is set to a value within the range of 0.5 mm to 1.2 mm.

The regulating pole 29 is formed with a magnet roll 25 (FIG. 2) opposite to the end surface 32 of the magnetic member 30, and the end side facing the end surface 32 in the regulating pole 29 is set to the N pole. In this embodiment, the regulating pole 29 is set to be positioned approximately 5° further upstream than the magnetic member 30 when viewed from the rotating direction of the development sleeve 24. Based on this positioning, the peak of the magnetic force of the regulating pole 29 will be positioned further upstream than the tip part 31 of the magnetic member 30.

The magnet member 35 is a plate-shaped magnet that is connected to the upstream surface 33 of the magnetic member 30 when viewed from the rotating direction of the development sleeve 24, and which extends in the longitudinal direction of the development sleeve 24. The magnet member 35 has a tip part 34 extending toward the outer peripheral surface 26 of the development sleeve 24, and the tip part 34 is formed with a magnetic pole; for example, the N pole, of the same polarity as the regulating pole 29. The magnetic force of the magnet member 35 is set to be greater than the magnetic force of the regulating pole 29. Moreover, the tip part 34 of the magnet member 35 has an opposing surface 36 which is opposite to the outer peripheral surface 26 of the development sleeve 24. The size of step formed between the opposing surface 36 and the end surface 32 of the magnetic member 30 is kept within 3 mm. The foregoing step is preferably around 1 mm to 2 mm.

With the development device 20 including the regulating part R of the foregoing configuration, the magnetic brush layer D1 on the outer peripheral surface 26 is regulated as follows. A magnetic pole; for example, the S pole, that is possible to the regulating pole 29 and the tip part 34 of the magnet member 35 is induced to the tip part 31 of the magnetic member 30 based on the magnetic field of the regulating pole 29 and the magnetic field of the magnet member 35. Since the magnetic force of the magnet member 35 is set to be greater than the magnetic force of the regulating pole 29, a part of the developer of the magnetic brush layer D1 on the outer peripheral surface 26 formed with the pumping pole 27 attaches to and accumulates on the end surface 32 of the magnetic member 30 from the opposing surface 36 of the magnet member 35 as its heads toward the regulating part R pursuant to the rotation of the development sleeve 24. A development layer D2 is thereby formed on the opposing surface 36 and the end surface 32. The amount of developer to be accumulated can be adjusted by suitably setting the magnetic force of the regulating pole 29 and/or the magnetic force of the magnet member 35.

The magnetic brush layer D1 on the outer peripheral surface 26 contacts the development layer D2 on the opposing surface 36 of the magnet member 35 and the end surface 32 of the magnetic member 30, when passing the regulatory gap G pursuant to the rotation of the development sleeve 24, and a part thereof is scraped off. The magnetic brush layer D1 on the outer peripheral surface 26 is thereby regulated (the magnetic brush DB is subject to scraping). Consequently, the layer thickness of the regulated magnetic brush layer D3 becomes a predetermined thickness T that is smaller than the size of the regulatory gap G, and this thereby thinned and becomes uniform. In the first embodiment, the developer layer D2 functions as the deterioration suppressing part.

The regulated magnetic brush layer D3 is carried toward the drum surface of the photoreceptor drum 10 pursuant to the rotation of the development sleeve 24. Subsequently, the toner in the magnetic brush layer D3 adheres to the electrostatic latent image of the drum surface of the photoreceptor drum 10 based on the potential difference between the development bias applied to the development sleeve 24 and the drum bias applied to the photoreceptor drum 10. A toner image is thereby formed on the drum surface.

As described above, with the development device 20 according to this embodiment, the magnetic brush layer D1 on the outer peripheral surface 26 of the development sleeve 24 is regulated with the development layer D2 on the opposing surface 36 of the magnet member 35 and the end surface 32 of the magnetic member 30. Accordingly, unlike the conventional configuration of regulating the magnetic brush layer, which is firmly restrained based on magnetic force, with a regulating blade, the development device 20 is able to alleviate the stress that works on the developer upon regulating the magnetic brush layer D1. It is thereby possible to inhibit the deterioration of the developer caused by the stress.

Moreover, with the development device 20 according to this embodiment, since the magnetic brush layer is not regulated with a conventional regulating blade as described above, the regulatory gap G can be set larger than conventionally; specifically to a value within the range of 0.5 to 1.2 mm. This consequently facilitates the formation of the magnetic brush layer D3 with the thickness T based on the developer layer D2 on the opposing surface 36 of the magnet member 35 and the end surface 32 of the magnetic member 30.

Figure 3:
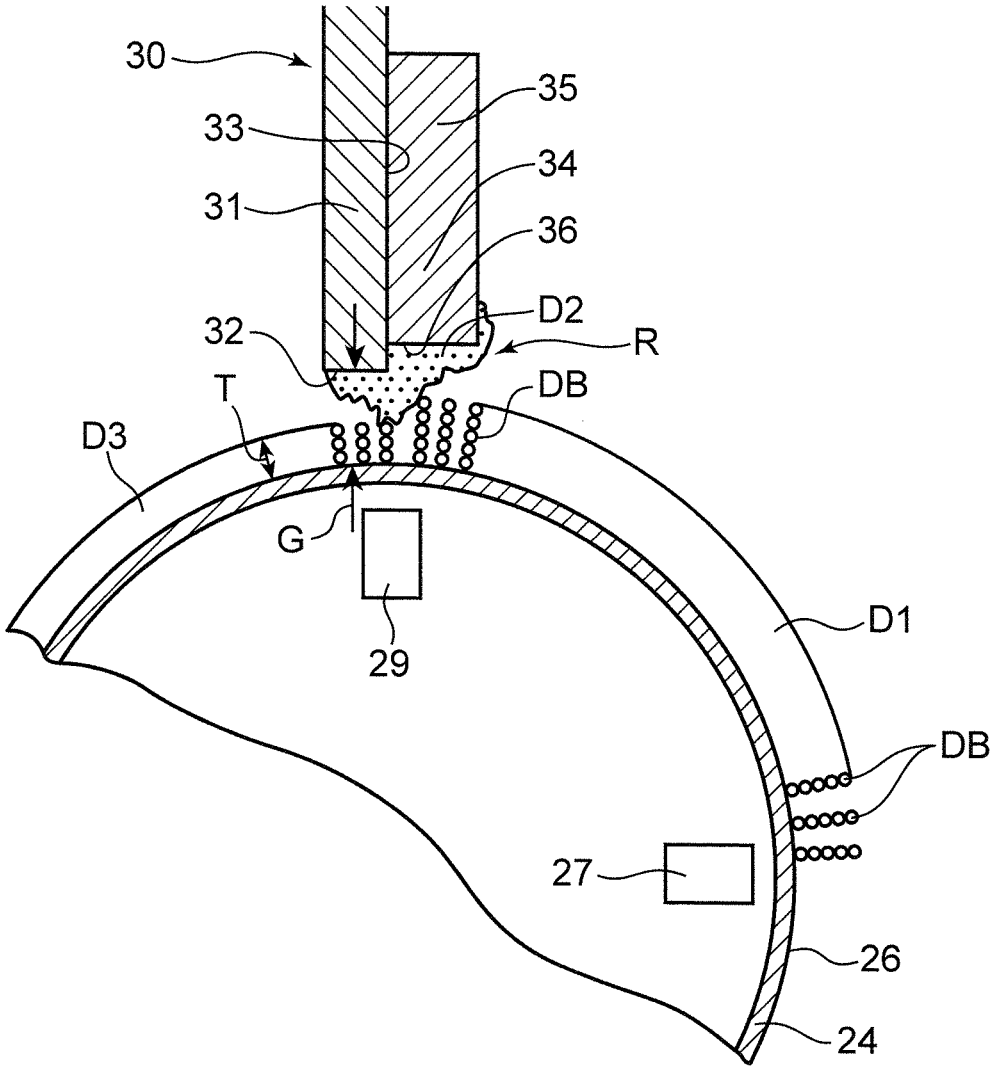
FIG. 3 is an enlarged view of the development roller of the development device and its periphery, and shows the operation of the regulating part.
Figure 4:
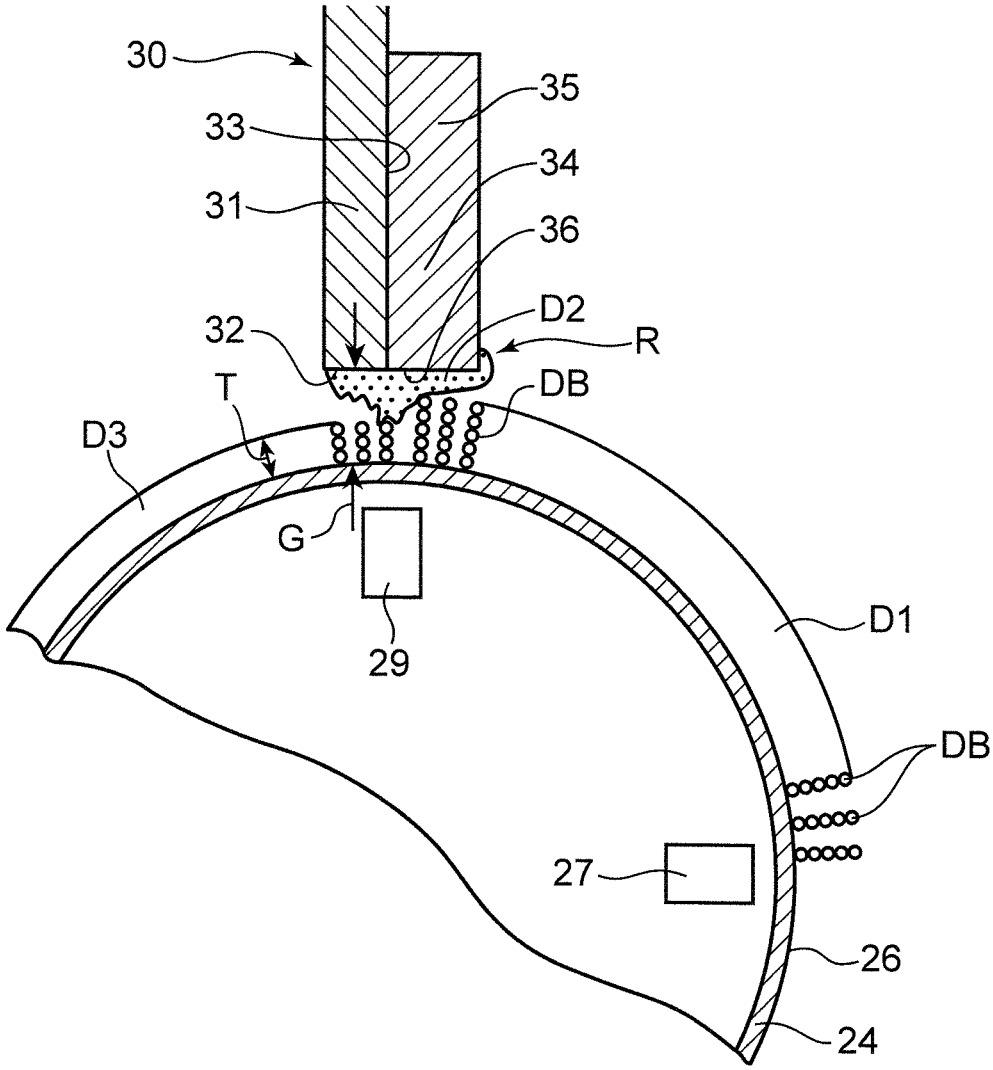
FIG. 4 is an enlarged view of the development roller of the development device and its periphery, and shows the operation of the regulating part.

With the development device 20 explained above, although the end surface 32 of the magnetic member 30 is configured to protrude farther downward toward the outer peripheral surface 26 than the opposing surface 36 of the magnet member 35, as an alternative configuration, as shown in FIG. 4, it is also possible to adopt a configuration where the end surface 32 of the magnetic member 30 and the opposing surface 36 of the magnet member 35 are set in a flush. Even in the case of the configuration shown in FIG. 4, since the magnetic force of the magnet member 35 is set to be greater than the magnetic force of the regulating pole 29, the developer layer D2 is formed from the opposing surface 36 to the end surface 32. The fact that the layer thickness of the magnetic brush layer D1 on the outer peripheral surface 26 is regulated with the developer layer D2 is as explained with reference to FIG. 3, and the deterioration of the developer can thereby be inhibited. Moreover, in the case of the configuration of FIG. 4, since there is no step between the end surface 32 of the magnetic member 30 and the opposing surface 36 of the magnet member 35, a lump of developer will not arise on the end surface 32 and the opposing surface 36 easily. It is thereby possible to prevent the occurrence of image deterioration such as streaks on the toner image.

Figure 5:
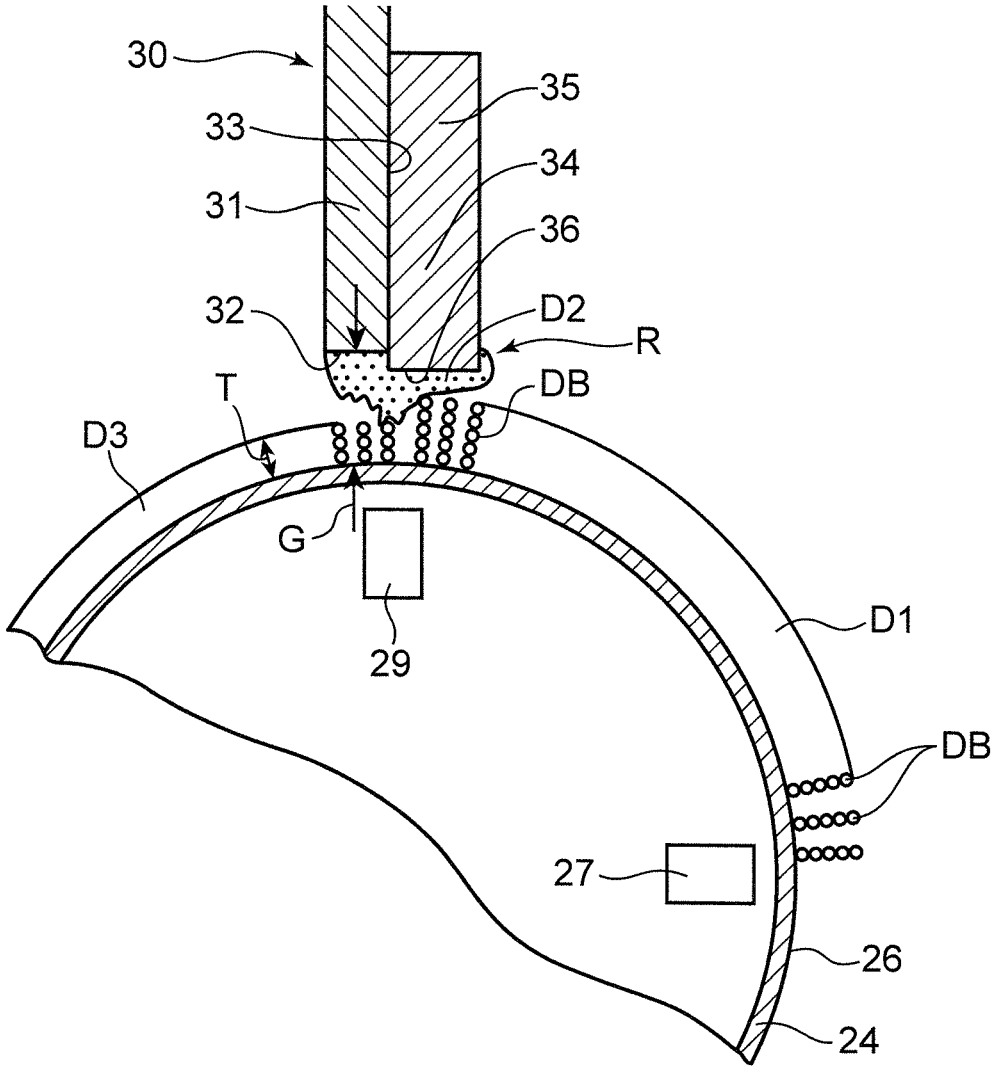
FIG. 5 is an enlarged view of the development roller of the development device and its periphery, and shows the operation of the regulating part.

In addition, the development device 20 may adopt, in substitute for the configuration shown in FIG. 3 and FIG. 4, a configuration where the opposing surface 36 of the magnet member 35 protrudes farther downward toward the outer peripheral surface 26 than the end surface 32 of the magnetic member 30 as shown in FIG. 5. The step between the opposing surface 36 and the end surface 32 is preferably kept down to approximately 1 mm. Even in the case of the configuration shown in FIG. 5, since the magnetic force of the magnet member 35 is set to be greater than the magnetic force of the regulating pole 29, the developer layer D2 is formed from the opposing surface 36 to the end surface 32. The fact that the layer thickness of the magnetic brush layer D1 on the outer peripheral surface 26 is regulated with the developer layer D2 is as explained with reference to FIG. 3, and the deterioration of the developer can thereby be inhibited.

Although the end surface 32 of the magnetic member 30 and the opposing surface 36 of the magnet member 35 are preferably set in a flush as shown in FIG. 4, the deterioration of the developer can also be inhibited with the configuration shown in FIG. 3 and FIG. 5. Accordingly, by setting the magnetic force of the magnet member 35 to be greater than the magnetic force of the regulating pole 29, it is possible to realize a margin in the mounting precision of the magnet member 35 on the magnetic member 30.

EXPERIMENT I

Experiment I that was conducted using the development device 20 is now explained. In Experiment I, the thinning stability of the magnetic brush layer, degradation of the image density upon printing, and generation of streak noise were checked. As the targets of the experiment, Examples 1 to 10 and Comparative Examples 1 to 3 were used. With Examples 1 to 10, as shown in FIG. 6, the magnetic force of the magnet member 35 was set to be greater than the magnetic force of the regulating pole 29, and the size of the regulatory gap G was set to a value within the range of 0.5 mm to 1.2 mm. With Comparative Example 1, the magnet member 35 was not used and only a conventional regulating blade was used, and the size of the regulatory gap G was set to 0.3 mm. With Comparative Examples 2 and 3, the magnetic force of the magnet member 35 was set to be smaller than the magnetic force of the regulating pole 29, and the size of the regulatory gap G was set to 0.3 mm and 0.4 mm, respectively. The regulatory gap G was set so that the amount of the regulated magnetic brush layer becomes 8 to 12 mg/cm$^2$ in all Examples 1 to 10 and Comparative Examples 1 to 3.

Moreover, with Examples 1 to 6, the opposing surface 36 of the magnet member 35 was set to be positioned approximately 1 mm above the end surface 32 of the magnetic member 30 (that is, the configuration of FIG. 3), with Examples 7 and 8, the end surface 32 and the opposing surface 36 were set to be flush (that is, the configuration of FIG. 4), and with Examples 9 and 10, the opposing surface 36 was set to be positioned approximately 1 mm below the end surface 32 (that is, the configuration of FIG. 5).

The results after driving the respective development devices 20 of Examples 1 to 10 and Comparative Examples 1 to 3 for 2 hours under the foregoing conditions are shown in FIG. 6. Note that the evaluation standard of the thinning stability of the magnetic brush layer, degradation of the image density, and streak noise is as follows. With respect to the thinning stability, if the amount of the magnetic brush layer after driving the development device 20 for 2 hours was within the range of 8 to 12 mg/cm$^2$, the thinning stability of the magnetic brush layer was evaluated as high and indicated as ○, and the thinning stability of the magnetic brush layer was evaluated low and indicated as x if it was outside the foregoing range. Moreover, the thickness of the magnetic brush layer in Examples 1 to 10 and Comparative Examples 1 to 3 was also checked. The layer thickness of the magnetic brush layer was measured by with a microscope at the position of the magnetic pole, or a transporting pole, that is further downstream than the regulating pole 29 when viewed from the rotating direction of the development sleeve 24.

Moreover, the image density was evaluated based on the measurement result of the reflecting density meter. The reflecting density upon starting the drive of the development device 20 was set to 1.4, and the image density was evaluated as favorable and indicated as ○ if the reflecting density after driving the development device 20 for 2 hours was 1.2 or more, and evaluated as inferior and indicated as x if the reflecting density was less than 1.2. Moreover, with respect to the streak noise, ○ is indicated when it was visually confirmed that there are no streaks on the printed paper, and Δ is indicated if there are streaks but they are within a tolerable range.

As shown in FIG. 6, since Examples 1 to 10 adopt a configuration of regulating the magnetic brush layer with the developer layer on the opposing surface 36 of the magnet member 35 and the end surface 32 of the magnetic member 30, the magnetic brush layer is thinned and becomes uniform, and the evaluation of the thin layer stability and the image density was consequently high. Meanwhile, since Comparative Example 1 adopts a conventional configuration of regulating the magnetic brush layer with a regulating blade by restraining the developer with the magnetic force of the regulating pole 29, for example, inconveniences such as the developer getting clogged in the regulatory gap G, and the size of the regulatory gap G varying tended to arise. Due to the foregoing inconveniences, the magnetic brush layer could not be thinned and did not become uniform, and the evaluation of the thin layer stability and the image density was consequently low. Moreover, although the evaluation of the thin layer stability of Comparative Examples 2 and 3 was high, the evaluation of the image density was low. The reason for this is considered to be as follows; specifically, as a result of the magnetic force of the regulating pole 29 being set to be greater than the magnetic force of the magnet member 35, the restraint of the developer caused by the regulating pole 29 became too strong and the toner could not be transferred to the photoreceptor drum 10.

With respect to the streak noise, streaks could not be confirmed in Example 1, Example 2, Example 4, Example 5, Examples 7 to 10, and Comparative Example 2 and Comparative Example 3. Meanwhile, streaks were confirmed in Example 3 and Example 6, although they were in a tolerable range. The reason for this is considered to be as follows; specifically, as a result of setting the regulatory gap G to 1.2 mm in Example 3 and setting the regulatory gap G to 1.1 mm in Example 6, the thickness of the magnetic brush layer became slightly larger in comparison to the other Examples. Nevertheless, so as long as the size of the regulatory gap G is within the range of 0.5 mm to 1.2 mm, it has been confirmed that an image, which is trouble-free under normal circumstances, can be obtained even with the generation of some streaks.

In this embodiment explained above, in addition to setting the magnetic force of the magnet member 35 to be greater than the magnetic force of the regulating pole 29, by setting the saturation magnetization of the developer carrier, the magnetic brush layer D1 can be regulated even more favorably with the developer layer D2 on the opposing surface 36 of the magnet member 35 and the end surface 32 of the magnetic member 30.

Specifically, since the regulation of the magnetic brush layer D1 with the developer layer D2 on the opposing surface 36 and the end surface 32 is affected by the magnetic force of the carrier, in this embodiment, the saturation magnetization of the carrier is set to a value within the range of 40 emu/g to 70 emu/g.

If the saturation magnetization of the carrier exceeds 75 emu/g, the amount of developer that is accumulated on the end surface 32 of the magnetic member 30 and the opposing surface 36 of the magnet member 35 will become too great, and the regulatory gap G tends to get clogged. Consequently, the regulating force of the developer layer D2 on the end surface 32 of the magnetic member 30 and the opposing surface 36 of the second magnet will become too strong, which in turn will cause the stress working on the developer to increase and tend to deteriorate the developer.

Meanwhile, if the saturation magnetization is less than 40 emu/g, the magnetic restraint for restraining the developer with the magnetic force of the regulating pole 29 and the magnet member 35 becomes weak. Thus, it becomes difficult to stably form the magnetic brush layer D1 on the outer peripheral surface 26 of the development sleeve 24, and stably form the developer layer D2 on the end surface 32 of the magnetic member 30 and the opposing surface 36 of the magnet member 35. Consequently, it is not possible to achieve the thinning and uniformity of thin the magnetic brush layer D1.

EXPERIMENT II

Experiment II that was conducted using the development device 20 is now explained. In Experiment II, the thinning stability of the magnetic brush layer, degradation of the image density upon printing, and generation of streaky noise were checked based on different saturization magnetization of the carrier. As the targets of the experiment, as shown in FIG. 7, Example 11 and Example 12 using a carrier A with saturation magnetization of 62 emu/g, Example 13 using a carrier B with saturation magnetization of 75 emu/g, Example 14 using a carrier C with saturation magnetization of 40 emu/g, Comparative Example 4 using a carrier D with saturation magnetization of 80 emu/g, and Comparative Example 5 using a carrier E with saturation magnetization of 35 emu/g were used. In all Examples 11 to 14 and Comparative Examples 4 and 5, the magnetic force of the magnet member 35 was set to be greater than the magnetic force of the regulating pole 29.

The carriers A to E were prepared as follows.

Carrier A: Foremost, ferrite particles (weight average particle size of 35 μm) were retained for 1 hour in a rotary-type air atmosphere furnace maintained at 500° C., and oxide coating treatment was performed to the ferrite particle surface to obtain a carrier core. Subsequently, 1000 parts by mass of the carrier core was covered, based on the dipping method, by a resin liquid obtained by diluting 20 parts by mass of KR-251 (methyl silicone resin produced by Shin-Etsu Chemical Co., Ltd.) in 500 parts by mass of the solvent (toluene). After the coating treatment, the carrier core was baked for 3 hours at 250° C. to remove cracking and coarse powders, and a carrier A with a degree of circularity of 0.913, saturation magnetization of 62 emu/g, and particle size of 35 μm was produced.

Carrier B: Foremost, spherical ferrite particles (weight average particle size of 35 μm) were retained for 1 hour in a rotary-type air atmosphere furnace maintained at 500° C., and oxide coating treatment was performed to the ferrite particle surface to obtain a carrier core. Subsequently, 1000 parts by mass of the carrier core was covered, based on the dipping method, by a resin liquid obtained by diluting 20 parts by mass of KR-251 (methyl silicone resin produced by Shin-Etsu Chemical Co., Ltd.) in 500 parts by mass of the solvent (toluene). After the coating treatment, the carrier core was baked for 3 hours at 250° C. to remove cracking and coarse powders, and a carrier B with a degree of circularity of 0.967, saturation magnetization of 75 emu/g, and particle size of 35 μm was produced.

Carrier C: Foremost, oxide coating treatment was performed to the ferrite particle surface of ferrite particles (weight average particle size of 35 μm) to obtain a carrier core. Subsequently, 1000 parts by mass of the carrier core was covered, based on the dipping method, by a resin liquid obtained by diluting 20 parts by mass of KR-251 (methyl silicone resin produced by Shin-Etsu Silicones) in 500 parts by mass of the solvent (toluene). After the coating treatment, the carrier core was baked for 3 hours at 250° C. to remove cracking and coarse powders, and a carrier C with a degree of circularity of 0.912, saturation magnetization of 40 emu/g, and particle size of 35 μm was produced.

Carrier D: Spherical ferrite particles (weight average particle size of 35 μm) were used as the carrier core, and 1000 parts by mass of the carrier core was covered, based on the dipping method, by a resin liquid obtained by diluting 20 parts by mass of KR-251 (methyl silicone resin produced by Shin-Etsu Silicones) in 500 parts by mass of the solvent (toluene). After the coating treatment, the carrier core was baked for 3 hours at 250° C. to remove cracking and coarse powders, and a carrier D with a degree of circularity of 0.968, saturation magnetization of 80 emu/g, and particle size of 35 μm was produced.

Carrier E: Foremost, oxide coating treatment was performed to the ferrite particle surface of ferrite particles (weight average particle size of 35 μm) to obtain a carrier core. Subsequently, 1000 parts by mass of the carrier core was covered, based on the dipping method, by a resin liquid obtained by diluting 20 parts by mass of KR-251 (methyl silicone resin produced by Shin-Etsu Silicones) in 500 parts by mass of the solvent (toluene). After the coating treatment, the carrier core was baked for 3 hours at 250° C. to remove cracking and coarse powders, and a carrier E with a degree of circularity of 0.913, saturation magnetization of 35 emu/g, and particle size of 35 μm was produced.

The weight average particle size of the carriers A to E was unified at 35 μm as described above. If the weight average particle size is too large, it becomes difficult to obtain a high-quality image since the uniformity of solid and half tones will deteriorate. Meanwhile, if the weight average particle size is too small, carrier adhesion tends to occur.

Each of the carriers A to E was mixed with a black toner with a volume average particle size of 6.8 μm to prepare the developer. The ratio of the carrier to the toner in the developer was set to 11:100 ratio by weight.

The results after driving the respective development devices 20 of Examples 11 to 14 and Comparative Examples 4 and 5 for 2 hours under the foregoing conditions are shown in FIG. 6. Note that the evaluation standard of the thinning stability of the magnetic brush layer, degradation of the image density, and streak noise is the same as foregoing Experiment I, and the explanation thereof is omitted.

As shown in FIG. 7, since the saturation magnetization of the carriers A to C is set within the range of 40 to 75 emu/g, the evaluation of the thin layer stability and the image density in Example 11 to Example 14 was high. Although the evaluation of the thin layer stability was high in Comparative Example 4, the evaluation of the image density was low. This is because the saturation magnetization of the carrier D exceeded the upper limit value of 75 emu/g. Moreover, although the evaluation of the image density was high in Comparative Example 5, the evaluation of the thin layer stability was low. This is because the saturation magnetization of the carrier E was less than the lower limit value of 40 emu/g.

With respect to the streak noise, no streaks were confirmed in Example 11, Example 13, Example 14, Comparative Example 4 and Comparative Example 5. Meanwhile, streaks were confirmed in Example 12 although they were within a tolerable range. The reason for this is considered to be as follows; specifically, with Example 12, as a result of the magnetic force of the carrier A and the magnetic force of the magnet member 35 both being set considerably greater than the other Examples, the amount of developer that was accumulated on the end surface 32 of the magnetic member 30 and the opposing surface 36 of the magnet member 35 became great, and the regulating force of the developer layer on the end surface 32 and the opposing surface 36 became strong.

Note that, in addition to setting the saturation magnetization of the carrier to be within the range of 40 to 75 emu/g, image deterioration can also be inhibited by setting the resistance value of the carrier to be within the range of 1E+6 to 9Ω. In addition, image deterioration can also be inhibited by using a toner externally added with alumina.

The development device 200 and the image forming apparatus 100 equipped with the development device 200 according to the second embodiment are now explained with reference to the drawings.

Figure 8:
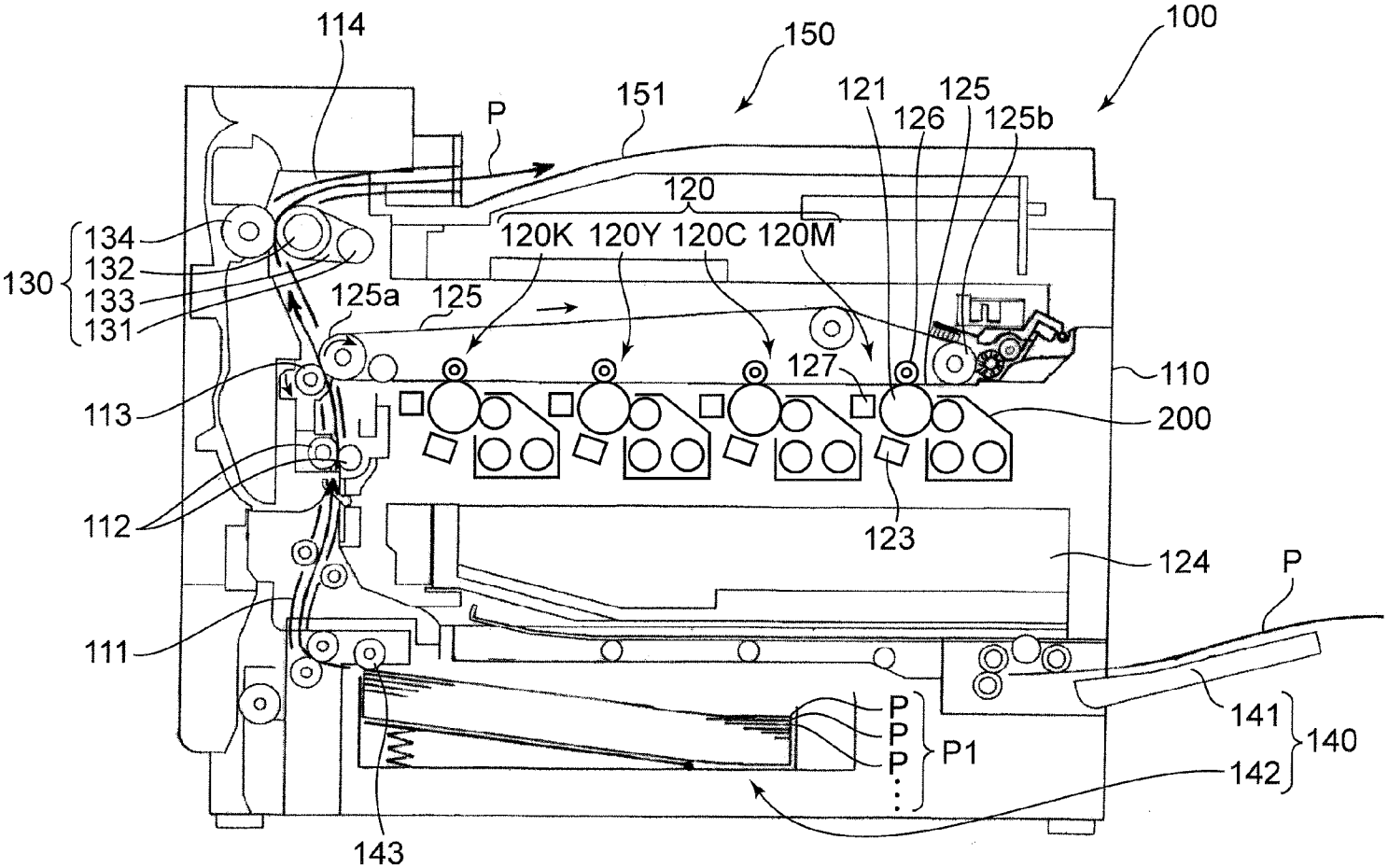
FIG. 8 is a diagram schematically shows the internal structure of the image forming apparatus equipped with the development device according to the second embodiment of the present invention.

FIG. 8 schematically shows the internal structure of the image forming apparatus 100 equipped with the development device 200 of the second embodiment. The image forming apparatus 100 is, for example, a tandem-type color printer, and includes a box-shaped apparatus body 110. The apparatus body 110 internally includes an image forming part 120 for forming an image based on image information sent from an external device such as a computer, a fixation part 130 formed with the image forming part 120 and which performs fixation treatment to the image transferred onto the paper P (sheet), and a paper storage part 140 for storing the paper P to which an image is to be transferred. A paper discharge part 150 to which the paper P subject to fixation treatment is discharged is provided at the upper part of the apparatus body 110.

The image forming part 120 is used for forming a toner image on the paper P fed from the paper storage part 140, and, in this embodiment, includes a magenta unit 120M which uses a magenta-colored toner (developer), a cyan unit 120C which uses a cyan-colored toner, a yellow unit 120Y which uses a yellow-colored toner, and a black unit 120K which uses a black-colored toner which are sequentially disposed from the upstream side (right side of the plane of paper of FIG. 8) toward the downstream side.

The respective units 120M, 120C, 120Y, 120K include a photoreceptor drum 121 and a development device 200. The photoreceptor drum 121 is used for forming an electrostatic latent image on the circumferential surface and a toner image (visible image) along such electrostatic latent image, and receives the supply of the toner from the corresponding development device 200 while rotating in the counterclockwise direction in FIG. 8. The respective development devices 200 receive the re-supply of the toner from a toner cartridge not shown.

A charging device 123 is provided immediately below the respective photoreceptor drums 121, and an exposure device 124 is provided below the respective charging devices 123. The respective photoreceptor drums 121 are uniformly charged on the circumferential surface thereof with the charging device 123, and laser beams corresponding to the respective colors based on the image data input from a computer or the like are irradiated from the exposure device 124 to the circumferential surface of the charged photoreceptor drum 121. An electrostatic latent image is thereby formed on the circumferential surface of the respective photoreceptor drums 121. When the toner from the development device 200 is subsequently supplied to the electrostatic latent image, a toner image is formed on the circumferential surface of the photoreceptor drum 121.

A transfer belt 125 stretched tightly between a driving roller 125*a* and a driven roller 125*b* is provided above the photoreceptor drum 121. The transfer belt 125 goes around between the driving roller 125*a* and the driven roller 125*b* while synching with the respectively photoreceptor drums 121 in a state of being pressed against the circumferential surface of the photoreceptor drum 121 with the transfer roller 126 provided in correspondence with the respective photoreceptor drums 121.

While the transfer belt 125 is going around, foremost performed in the primary transfer of the magenta toner image onto the surface of the transfer belt 125 based on the photoreceptor drum 121 of the magenta unit 120M. Subsequently, the transfer of the cyan toner image is performed, in an overpainted manner, to the transfer position of the magenta toner image on the transfer belt 125 based on the photoreceptor drum 121 of the cyan unit 120C. Similarly, the transfer of the yellow toner image based on the yellow unit 120Y and the transfer of the black toner image based on the black unit 120K are performed in an overpainted manner. A color toner image is thereby formed on the surface of the transfer belt 125.

A drum cleaning device 127 for removing the residual toner on the circumferential surface of the photoreceptor drum 121 and performing cleaning thereto is provided to the left-side position in FIG. 8 of the respective photoreceptor drums 121. The circumferential surface of the photoreceptor drum 121 that was subject to cleaning treatment with the drum cleaning device 127 heads toward the charging device 123 for new charge processing. The waste toner that was removed from the circumferential surface of the photoreceptor drum 121 with the drum cleaning device 127 passes through a predetermined path and is recovered in a toner recovery bottle not shown.

A paper transport path 111 extending in the vertical direction is formed at the left-side position in FIG. 8 of the image forming part 120. The paper transport path 111 is provided with a transport roller pair 112 at an appropriate location, and the paper P from the paper storage part 140 is transported toward the transfer belt 125 based on the drive of the transport roller pair 112. The paper transport path 111 is also provided with a secondary transfer roller 113 which comes in contact with the surface of the transfer belt 125 at a position that is opposite to the driving roller 125*a*. The secondary transfer roller 113 forms a transfer nip part with the image carrying surface of the transfer belt 125. The paper P is pressed and sandwiched between the transfer belt 125 and the secondary transfer roller 113 at the transfer nip part, and the toner image on the transfer belt 125 is thereby subject to secondary transfer onto the paper P.

The paper storage part 140 includes a manual feed tray 141 provided openably/closably to the right-side wall in FIG. 8 of the apparatus body 110, and a paper tray 142 mounted insertably/removably to a position that is lower than the exposure device 124 in the apparatus body 110. A paper bulk P1 in which a plurality of sheets P are layered is stored in the paper tray 142. The paper tray 142 is configured from a box body that is opened at the top, and is able to store the paper bulk P1. The uppermost paper P of the paper bulk P1 stored in the paper tray 142 is fed one by one toward the paper transport path 111 based on the drive of the pickup roller 143. The paper P fed from the paper tray 142 passes through the paper transport path 111 and is transported toward the transfer nip part based on the drive of the transport roller pair 112.

The fixation part 130 performs fixation treatment to the toner image on the paper P that was subject to the secondary transfer. The fixation part 130 includes a heating roller 131 internally provided with a conductive heating element as the heating source, a fixation roller 132 placed opposite to the heating roller 131, a fixation belt 133 stretched tightly between the fixation roller 132 and the heating roller 131, and a pressure roller 134 placed opposite to the fixation roller 132 via the fixation belt 133. The paper P supplied to the fixation part 130 is subject to the fixation treatment upon being subject to the heat from the fixation belt 133 while passing through between the pressure roller 134 and the high temperature fixation belt 133. The color-printed paper P that was subject to the fixation treatment passes through the paper discharge transport path 114 extending from the upper part of the fixation part 130, and is discharged toward the paper discharge tray 151 of the paper discharge part 150.

Figure 9:
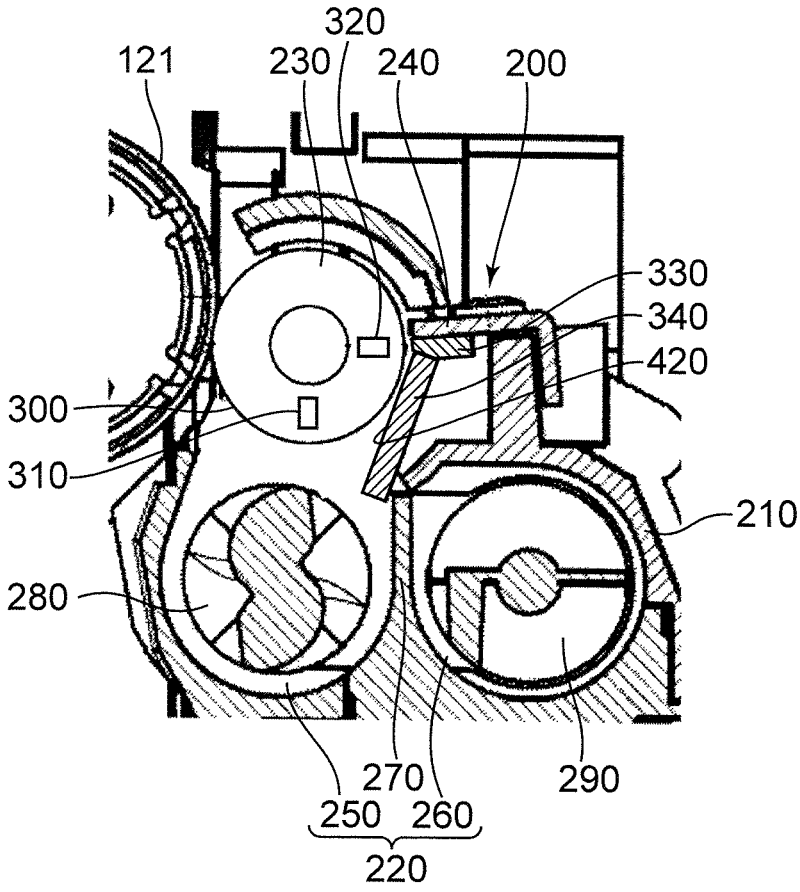
FIG. 9 is a cross section schematically showing the internal structure of the development device of the second embodiment.

FIG. 9 is a cross section schematically showing the internal structure of the development device 200. The development device 200 includes a development vessel 210 for defining its internal space. The development device 200 includes a developer storage part 220 capable of storing the developer in the development vessel 210 and agitating and transporting the developer, a development roller 230 (developer carrier) disposed above the developer storage part 220, and a developer regulating blade 240 (first regulating member) placed opposite to the development roller 230.

The developer storage part 220 is configured from two adjacent developer storage chambers 250, 260 extending in the longitudinal direction of the development device 200, and the developer storage chambers 250, 260 are mutually partitioned in the longitudinal direction with a partition plate 270 formed integrally with the development vessel 210, but both ends thereof in the longitudinal direction are in mutual communication. Moreover, a screw feeder 280, 290 for agitating the developer, based on rotation, is rotatably mounted on each developer storage chamber 250, 260. With the screw feeders 280, 290, since the rotating directions are set in mutually reverse directions, the developer is agitated and transported between the developer storage chamber 250 and the developer storage chamber 260. Based on this agitation, the magnetic body toner and the nonmagnetic carrier are mixed, and the toner is thereby charged.

The development roller 230 is disposed so as to extend in the longitudinal direction of the development device 200, and is able to rotate in the counterclockwise direction in FIG. 9. The development roller 230 includes a so-called fixed magnet roll (not shown) extending in the longitudinal direction of the development roller 230. The magnet roll is formed with a pumping pole 310 for magnetically pumping the developer from the developer storage chamber 250 onto the outer peripheral surface 300 of the development roller 230. The developer that is pumped with the pumping pole 310 is magnetically retained on the outer peripheral surface 300 of the development roller 230, and transported toward the developer regulating blade 240 pursuant to the rotation of the development roller 230.

The developer regulating blade 240 is used for regulating the layer thickness of the developer layer which was caused to magnetically adhere to the outer peripheral surface 300 of the development roller 230. The developer regulating blade 240 is a plate member made of a magnetic material that extends along the longitudinal direction of the development roller 230, and is supported at the appropriate location of the development vessel 210.

Figure 10:
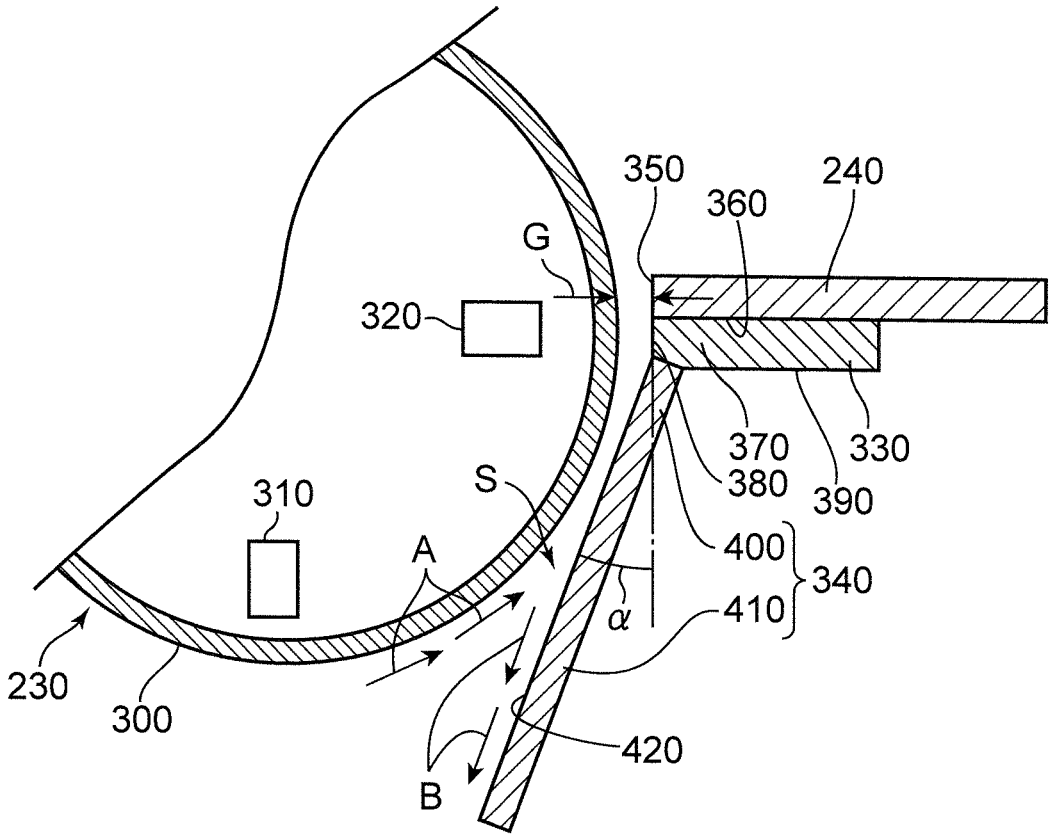
FIG. 10 is an enlarged view of the development device, and shows the periphery of the developer regulating blade.

Moreover, the developer regulating blade 240 includes, as shown in FIG. 10, an end surface 350 (hereinafter referred to as the "layer thickness regulating surface") which forms a predetermined regulatory gap G with the outer peripheral surface 300 of the development roller 230. The developer regulating blade 240 regulates the layer thickness of the developer layer via the layer thickness regulating surface 350.

The developer with a regulated layer thickness is carried toward the photoreceptor drum 121 pursuant to the rotation of the development roller 230, and adheres to the electrostatic latent image on the photoreceptor drum 121 based on the potential difference between the development bias applied to the development roller 230 and the drum bias applied to the photoreceptor drum 121. A toner image is thereby formed on the photoreceptor drum 121.

The magnet roll of the development roller 230 is formed with, in addition to the pumping pole 310, a regulating pole 320 at a position which is opposite to the layer thickness regulating surface 350 of the developer regulating blade 240. Accordingly, the developer regulating blade 240 formed from a magnetic material is magnetized with the regulating pole 320 of the development roller 230, and a magnetic path is formed between the layer thickness regulating surface 350 of the developer regulating blade 240 and the regulating pole 320; that is, in the regulatory gap G. Note that the pumping pole 310 and the regulating pole 320 are formed across the of approximately the same longitudinal direction length as the development roller 230.

A magnet member 330 is disposed further upstream than the developer regulating blade 240 when viewed from the rotating direction of the development roller 230. The developer regulating blade 240 includes an upstream surface 360 facing the upstream side of the rotating direction, and the magnet member 330 is connected to such upstream surface 360. The magnet member 330 is a plate-shaped member which extends in the longitudinal direction of the development device 200 along the developer regulating blade 240.

The magnet member 330 includes a tip part 370 extending toward the development roller 230, and the tip part 370 is formed with a magnetic pole of the same polarity as the regulating pole 320. Based on the magnetic field generated by the magnet member 330, the magnetic flux density of the magnetic field (magnetic path) generated between the developer regulating blade 240 and the regulating pole 320 will increase.

Moreover, the tip part 370 of the magnet member 330 has an opposing surface 380 which is opposite to the development roller 230. The thickness of the magnet member 330 in the opposing surface 380 is defined by the rotating direction of the development roller 230. The opposing surface 380 and the layer thickness regulating surface 350 of the developer regulating blade 240 are set to be an approximately flush state. Consequently, step is not formed between the opposing surface 380 and the layer thickness regulating surface 350.

A transport amount regulating member 340 (second regulating member) is disposed further upstream than the magnet member 330 when viewed from the rotating direction of the development roller 230. The transport amount regulating member 340 has the approximately same width size as the longitudinal direction length of the development roller 230, and is a plate-shaped member formed from a nonmagnetic material such as resin. The transport amount regulating member 340 includes a base end part 400 connected to the upstream surface 390 of the magnet member 330 when viewed from the rotating direction of the development roller 230, and a main body part 410 extending from the base end part 400 to the upstream side in the rotating direction of the development roller 230 and along the outer peripheral surface 300 of the development roller 230.

The main body part 410 has a flat surface (hereinafter referred to as the "transport amount regulating surface 420") opposite to the outer peripheral surface 300 of the development roller 230. The main body part 410 is set to gradually become separated from the development roller 230 as it heads toward the upstream side of the rotating direction. In other words, the transport amount regulating surface 420 of the main body part 410 is set so that the space S between the transport amount regulating surface 420 and the outer peripheral surface 300 of the development roller 230 gradually becomes larger as it heads toward the upstream side of the rotating direction of the development roller 230. The transport amount regulating member 340 regulates the transport amount of the developer that is transported toward the developer regulating blade 240 based on the transport amount regulating surface 420.

Figure 11:
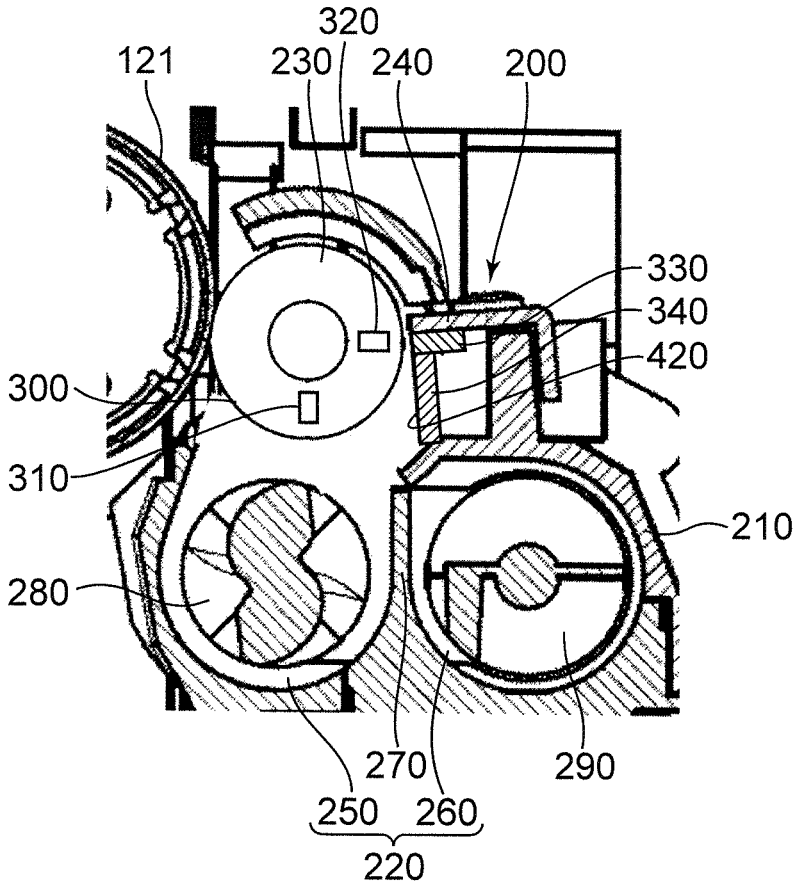
FIG. 11 is a diagram showing a modified example of the transport amount regulating member of the development device.

Nevertheless, it is not desirable to unnecessary expand the space S, and the transport amount regulating surface 420 is set to form a predetermined angle (hereinafter referred to as the "regulating angle $\alpha$") on a side of approaching the development roller 230 relative to the layer thickness regulating surface 350 of the developer regulating blade 240. As a result of suitably setting the regulating angle $\alpha$, it is possible to adjust the size of the space S between the transport amount regulating surface 420 and the outer peripheral surface 300 of the development roller 230. As a result of suitably setting the size of the space S, the transport amount of the developer that is transported to the developer regulating blade 240 is set. Note that the transport amount regulating surface 420 does not necessarily have to form the predetermined regulating angle $\alpha$ relative to the layer thickness regulating surface 350, and, as shown in FIG. 11, it may also be set at a position that is approximately on the same plane as the layer thickness regulating surface 350 (that is, to become perpendicular to the upstream surface 390). Moreover, the length of the transport amount regulating surface 420 extending toward the upstream side of the rotating direction of the development roller 230 is suitably set.

With the development device 200 configured as described above, the developer is regulated as follows. Specifically, the developer which was caused to magnetically adhere to the outer peripheral surface 300 of the development roller 230 from the developer storage chamber 250 based on the pumping pole 310 gradually approaches, as shown with arrow A, the transport amount regulating surface 420 of the transport amount regulating member 340 pursuant to the rotation of the development roller 230. Although the developer is transported to the space S between the transport amount regulating surface 420 and the outer peripheral surface 300 of the development roller 230, the space S becomes narrower as its heads toward the downstream side of the rotating direction of the development roller 230. Thus, apart of the developer that is being transported is gradually pushed back in a direction (arrow B) that is opposite to the rotating direction (counterclockwise direction in FIG. 10) of the development roller 230 based on the transport amount regulating surface 420, and returns to the developer storage chamber 250. The transport amount of the developer that is transported to the developer regulating blade 240 is thereby regulated with the transport amount regulating surface 420.

Thus, the developer is transported toward the developer regulating blade 240 in an amount that is affected by the magnetic field generated between the regulating pole 320 and the developer regulating blade 240. The layer thickness of the developer layer (so-called magnetic brush layer) is thereby regulated with the developer regulating blade 240. Moreover, unlike the conventional configuration where the transport amount of the developer that is transported to the developer regulating blade is considerably more than the amount of the developer that passes through the regulatory gap, it is possible to inhibit the accumulation of the developer in a range around the developer regulating blade 240 that is not affected by the magnetic field. Consequently, it is possible inhibit the deterioration of the developer caused by the foregoing accumulation. In the second embodiment, the transport amount regulating member 34 functions as the deterioration suppressing part.

Moreover, since the magnet member 330 with a magnetic pole of the same polarity as the regulating pole 320 is disposed on the upstream side of the developer regulating blade 240 when viewed from the rotating direction of the development roller 230, it is possible to increase the magnetic flux density of the magnetic field that is generated between the developer regulating blade 240 and the regulating pole 320 based on the magnetic field generated by the magnet member 330. Thus, the range that is affected by the magnetic field between the developer regulating blade 240 and the regulating pole 320 will increase, and the distance; that is, the regulatory gap G between the developer regulating blade 240 and the development roller 230 can be increased. It is thereby possible to stably transport the developer and alleviate the stress that works on the developer when it is regulated by the developer regulating blade 240.

Moreover, according to the development device 200, since it is possible to adjust the size of the space S between the transport amount regulating surface 420 and the outer peripheral surface 300 of the development roller 230 as a result of suitably setting the regulating angle α, the amount of the developer to the transported toward the developer regulating blade 240 can be easily set.

In addition, according to the development device 200, since the magnet member 330 is connected to the upstream surface 360 of the developer regulating blade 240, no gap is formed between the magnet member 330 and the upstream surface 360 which will allow the accumulation of the developer. Moreover, since the layer thickness regulating surface 350 of the developer regulating blade 240 and the opposing surface 380 of the magnet member 330 are set to be approximately flush, no step is formed between the layer thickness regulating surface 350 and the opposing surface 380 which will allow the accumulation of the developer. It is thereby possible to further stabilize the transport amount of the developer to be transported toward the developer regulating blade 240.

In addition, according to the development device 200, since the transport amount regulating member 340 is formed from a nonmagnetic material such a resin, the developer that is transported toward the developer regulating blade 240 in a charged state will not adhere easily to the transport amount regulating surface 420 when the transport amount thereof is regulated with the transport amount regulating surface 420.

EXPERIMENT III

Figure 13:
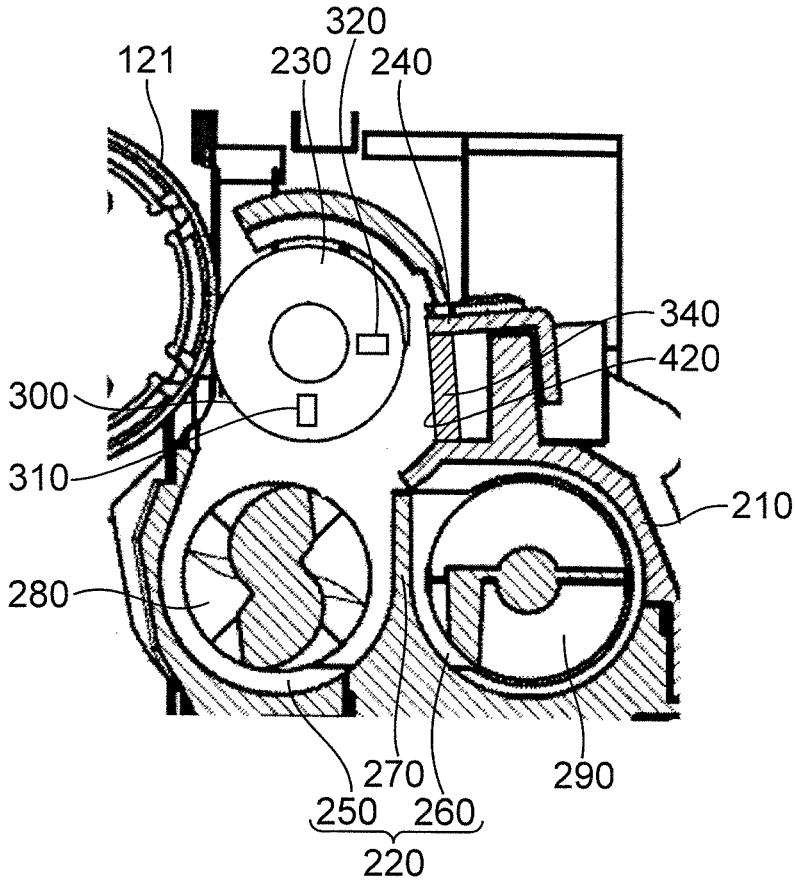
FIG. 13 is a diagram showing the development device of a mode which uses only the developer regulating blade and the transport amount regulating member.
Figure 14:
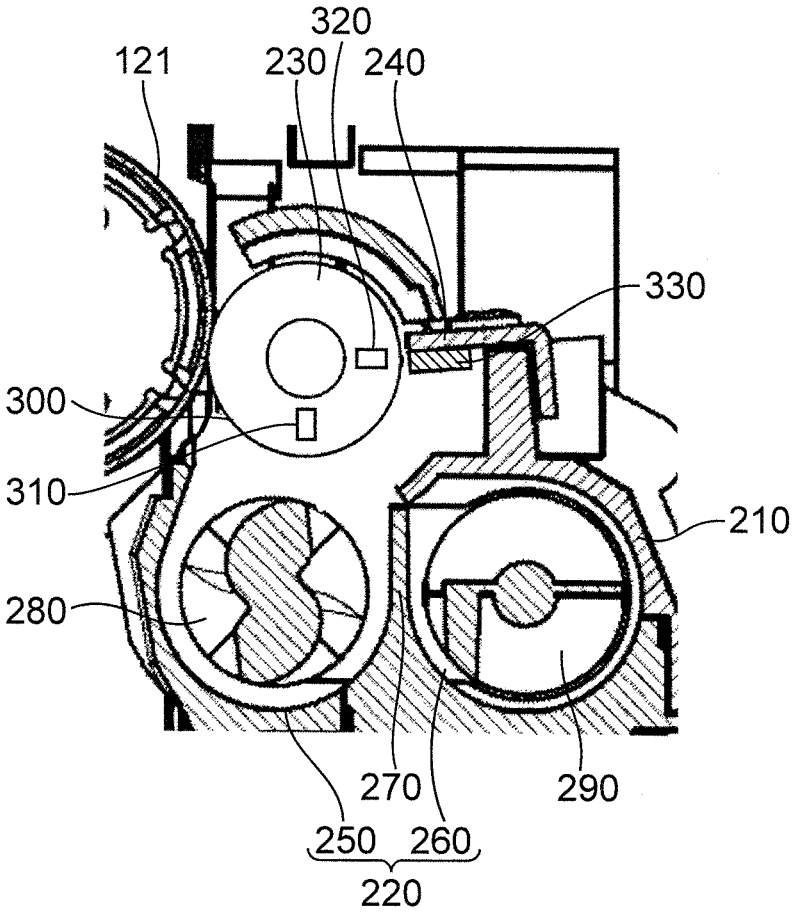
FIG. 14 is a diagram showing the development device of a mode which uses only the developer regulating blade and the magnet member.

Experiment III that was conducted using the development device 200 is now explained. In Experiment III, how the transport amount (mg/cm$^2$) of the developer layer (magnetic brush layer) that passed through the regulatory gap G changes upon changing the size of such regulatory gap G. As the targets of the experiment, Examples 1 to 4 and Comparative Examples 1 to 6 which mutually have a different regulating angle α of the transport amount regulating surface 420, thickness of the magnet member 330, magnetic force of the magnet member 330, and size of step between the layer thickness regulating surface 350 and the opposing surface 380 were used. The setting conditions of Examples 1 to 4 and Comparative Examples 1 to 6 are shown in FIG. 12. Comparative Example 1 shows a mode of only using the developer regulating blade 240, Comparative Example 2 shows a mode of using the developer regulating blade 240 and the transport amount regulating member 340 as shown in FIG. 13, and Comparative Examples 3 to 6 show a mode of using the developer regulating blade 240 and the magnet member 330 as shown in FIG. 14. Meanwhile, Examples 1 to 4 show a mode of using the transport amount regulating member 340 and the magnet member 330 in addition to the developer regulating blade 240 as shown in FIG. 10.

Moreover, with Experiment III, a development roller 230 subject to blast treatment was used, and a developer containing a toner with an average particle size of 6.8 μm and T/C (ratio of toner to carrier) of 11% and a carrier with an average particle size of 35 μm, and saturation magnetization of 60 emu/g was used. The transport amount of the developer after operating the respective development devices of Examples 1 to 4 and Comparative Examples 1 to 6 for a predetermined period of time was measured. The results are shown in FIG. 15 and FIG. 16.

Figure 15:
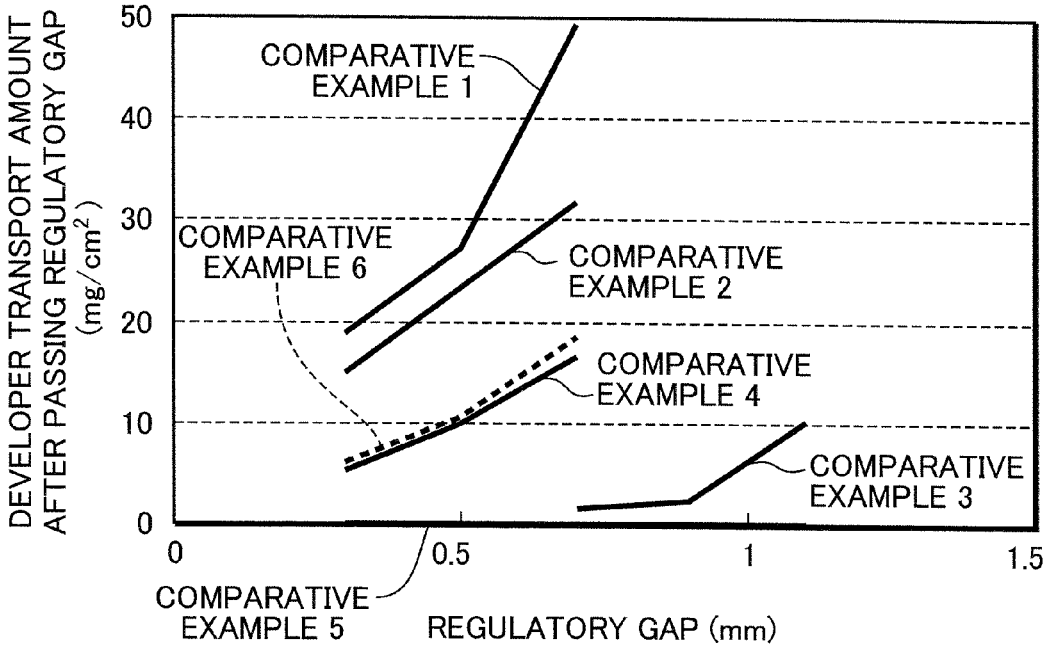
FIG. 15 is a diagram showing the results of the Comparative Examples.

As shown in FIG. 15, with Comparative Example 1 which only used the developer regulating blade 240, the transport amount of the developer drastically increased as the regulatory gap G was enlarged. Even with Comparative Example 2 that used the developer regulating blade 240 and the transport amount regulating member 340, the transport amount of the developer drastically increased as the regulatory gap G was enlarged.

With Comparative Example 3, 4 and 6 which used the developer regulating blade 240 and the magnet member 330, the transport amount of the developer was suppressed at 20 mg/cm$^2$ or less even if the regulatory gap G was enlarged, but lacked stability in relation to changes in the regulatory gap G. Moreover, with Comparative Example 5, the restraint of the developer caused by the developer regulating blade 240 became too strong and it was not possible to form a magnetic brush layer.

Figure 16:
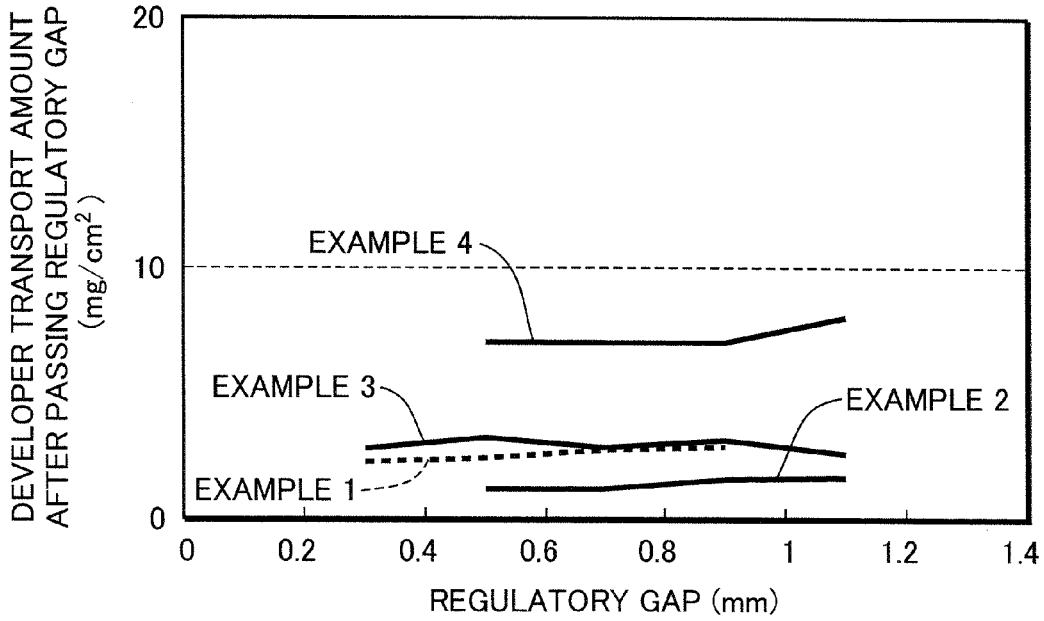
FIG. 16 is a diagram showing the results of the Examples.

Meanwhile, as shown in FIG. 16, with Examples 1 to 4 which used the developer regulating blade 240, the transport amount regulating member 340 and the magnet member 330, it was possible to realize a low transport amount of 10 mg/cm$^2$ or less even when the regulatory gap G was enlarged. Moreover, the transport amount was stable in relation to changes in the regulatory gap G. As a result of using the transport amount regulating member 340 and the magnet member 330 in addition to the developer regulating blade 240 as described above, it was possible to realize a low transport amount of the developer and a stable transport amount.

This application is based on Japanese Patent application serial Nos. 2009-289332, 2009-289476 and 2010-093073 filed in Japan Patent Office on Dec. 21, 2009 and Apr. 14, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A development device comprising:

a developer storage part storing a developer while agitating the developer;

a developer carrier having a carrying surface for carrying the developer, and a first magnet, the developer carrier receiving the developer on the carrying surface from the developer storage part while rotating in a predetermined direction, and supplying the developer to a predetermined image carrier;

a magnetic member formed from a magnetic material, the magnetic member forming a predetermined regulatory gap with the carrying surface and arranged opposite to the first magnet;

a second magnet arranged more upstream than the magnetic member when viewed from the rotating direction of the developer carrier, and having a magnetic pole of the same polarity as the first magnet; and a deterioration suppressing part suppressing deterioration of the developer that is transported to the regulatory gap along with the rotation of the developer carrier, wherein magnetic force of the second magnet is set greater than magnetic force of the first magnet, the magnetic member has an end surface that is opposed to the carrying surface to form the regulatory gap, the second magnet has an opposing surface that is opposed to the carrying surface, and the deterioration suppressing part is a developer layer formed from the end surface of the magnetic member to the opposing surface of the second magnet.

2. The development device according to claim 1, wherein the developer includes a magnetic carrier, and saturation magnetization of the carrier is set in a range of 40 to 75 emu/g.

3. The development device according to claim 1, wherein the regulatory gap is set in a range of 0.5 to 1.2 mm.

4. The development device according to claim 1, wherein the magnetic member has an upstream surface facing an upstream side when viewed from the rotating direction of the developer carrier, the second magnet is a magnet mounted on the upstream surface, and the end surface of the magnetic member and the opposing surface of the second magnet are set flush.

5. The development device according to claim 1, wherein the magnetic member has an upstream surface facing an upstream side when viewed from the rotating direction of the developer carrier, the second magnet is a magnet mounted on the upstream surface, and the end surface of the magnetic member protrudes further toward the carrying surface than the opposing surface of the second magnet.

6. The development device according to claim 1, wherein the magnetic member includes an upstream surface facing an upstream side when viewed from the rotating direction of the developer carrier, the second magnet is a magnet mounted on the upstream surface, and the opposing surface of the second magnet protrudes further toward the carrying surface than the end surface of the magnetic member.

7. A development device comprising:

a developer storage part storing a developer while agitating the developer;

a developer carrier having a carrying surface for carrying the developer, and a first magnet, the developer carrier receiving the developer on the carrying surface from the developer storage part while rotating in a predetermined direction, and supplying the developer to a predetermined image carrier;

a magnetic member formed from a magnetic material, the magnetic member forming a predetermined regulatory gap with the carrying surface and arranged opposite to the first magnet;

a second magnet arranged more upstream than the magnetic member when viewed from the rotating direction of the developer carrier, and having a magnetic pole of the same polarity as the first magnet; and a deterioration suppressing part suppressing deterioration of the developer that is transported to the regulatory gap along with the rotation of the developer carrier, wherein the magnetic member is a first regulating member forming a magnetic path with the first magnet to magnetically regulate layer thickness of the developer on the carrying surface, the first regulating member has a layer thickness regulating surface that is opposed to the carrying surface to regulate the layer thickness of the developer, and has an upstream surface facing an upstream side when viewed from the rotating direction of the developer carrier, the second magnet has an opposing surface opposes to the carrying surface, and is bonded to the upstream surface of the first regulating member, and the layer thickness regulating surface and the opposing surface are set to be in an approximately flush state, the deterioration suppressing part is a second regulating member having a transport amount regulating surface positioned more upstream than the second magnet when viewed from the rotating direction of the developer carrier, and the transport amount regulating surface is set to become gradually separated from the carrying surface as the transport amount regulating surface heads toward the upstream side of the rotating direction of the developer carrier, and regulates an amount of the developer that is transported to the regulatory gap.

8. The development device according to claim 7, wherein the transport amount regulating surface forms a predetermined angle relative to the layer thickness regulating surface on a side approaching to the development carrier.

9. The development device according to claim 7, wherein the second regulating member is formed from a nonmagnetic material.

10. An image forming apparatus, comprising:

an image carrier which is to be formed with a toner image;

a development device which supplies a developer to the image carrier and forms the toner image on the image carrier;

a transfer member which transfers the toner image onto a sheet; and a fixation part which fixes the toner image on the sheet onto the sheet, wherein the development device includes:

a developer storage part storing a developer while agitating the developer;

a developer carrier having a carrying surface for carrying the developer, and a first magnet, the developer carrier receiving the developer on the carrying surface from the developer storage part while rotating in a predetermined direction, and supplying the developer to a predetermined image carrier;

a magnetic member formed from a magnetic material, the magnetic member forming a predetermined regulatory gap with the carrying surface and arranged opposite to the first magnet;

a second magnet arranged more upstream than the magnetic member when viewed from the rotating direction of the developer carrier, and having a magnetic pole of the same polarity as the first magnet; and a deterioration suppressing part suppressing deterioration of the developer that is transported to the regulatory gap along with the rotation of the developer carrier, wherein magnetic force of the second magnet is set greater than magnetic force of the first magnet, the magnetic member has an end surface that is opposed to the carrying surface to form the regulatory gap, the second magnet has an opposing surface that is opposed to the carrying surface, and the deterioration suppressing part is a developer layer formed from the end surface of the magnetic member to the opposing surface of the second magnet.

11. The image forming apparatus according to claim 10, wherein the developer includes a magnetic carrier, and saturation magnetization of the carrier is set in a range of 40 to 75 emu/g.

12. The image forming apparatus according to claim 10, wherein the regulatory gap is set in a range of 0.5 to 1.2 mm.

13. The image forming apparatus according to claim 10, wherein the magnetic member has an upstream surface facing an upstream side when viewed from the rotating direction of the developer carrier, the second magnet is a magnet mounted on the upstream surface, and the end surface of the magnetic member and the opposing surface of the second magnet are set flush.

14. The image forming apparatus according to claim 10, wherein the magnetic member has an upstream surface facing an upstream side when viewed from the rotating direction of the developer carrier, the second magnet is a magnet mounted on the upstream surface, and the end surface of the magnetic member protrudes further toward the carrying surface than the opposing surface of the second magnet.

15. The image forming apparatus according to claim 10, wherein the magnetic member includes an upstream surface facing an upstream side when viewed from the rotating direction of the developer carrier, the second magnet is a magnet mounted on the upstream surface, and the opposing surface of the second magnet protrudes further toward the carrying surface than the end surface of the magnetic member.

16. An image forming apparatus comprising:

an image carrier which is to be formed with a toner image;

a development device which supplies a developer to the image carrier and forms the toner image on the image carrier;

a transfer member which transfers the toner image onto a sheet; and a fixation part which fixes the toner image on the sheet onto the sheet, wherein the development device includes:

a developer storage part storing a developer while agitating the developer;

a developer carrier having a carrying surface for carrying the developer, and a first magnet, the developer carrier receiving the developer on the carrying surface from the developer storage part while rotating in a predetermined direction, and supplying the developer to a predetermined image carrier;

a magnetic member formed from a magnetic material, the magnetic member forming a predetermined regulatory gap with the carrying surface and arranged opposite to the first magnet;

a second magnet arranged more upstream than the magnetic member when viewed from the rotating direction of the developer carrier, and having a magnetic pole of the same polarity as the first magnet; and a deterioration suppressing part suppressing deterioration of the developer that is transported to the regulatory gap along with the rotation of the developer carrier, wherein the magnetic member is a first regulating member forming a magnetic path with the first magnet to magnetically regulate layer thickness of the developer on the carrying surface, the first regulating member has a layer thickness regulating surface that is opposed to the carrying surface to regulate the layer thickness of the developer, and has an upstream surface facing an upstream side when viewed from the rotating direction of the developer carrier, the second magnet has an opposing surface opposes to the carrying surface, and is bonded to the upstream surface of the first regulating member, and the layer thickness regulating surface and the opposing surface are set to be in an approximately flush state, the deterioration suppressing part is a second regulating member having a transport amount regulating surface positioned more upstream than the second magnet when viewed from the rotating direction of the developer carrier, and the transport amount regulating surface is set to become gradually separated from the carrying surface as the transport amount regulating surface heads toward the upstream side of the rotating direction of the developer carrier, and regulates an amount of the developer that is transported to the regulatory gap.

17. The image forming apparatus according to claim 16, wherein the transport amount regulating surface forms a predetermined angle relative to the layer thickness regulating surface on a side approaching to the development carrier.

18. The image forming apparatus according to claim 16, wherein the second regulating member is formed from a nonmagnetic material.

* * * * *